US005575030A

United States Patent [19]

Girard

[11] Patent Number: 5,575,030

[45] Date of Patent: Nov. 19, 1996

[54] CONTAINER OPENING PAINT BRUSH

[76] Inventor: Darcy T. Girard, 49 Deerfield Ave., East Hartford, Conn. 06108

[21] Appl. No.: 502,815

[22] Filed: Jul. 14, 1995

[51] Int. Cl.[6] ..... A46B 15/00

[52] U.S. Cl. ..... 15/105; 15/111; 15/236.01; 7/105; 7/151; D4/116

[58] Field of Search ..... 15/105, 111, 159.1, 15/167.3, 113, 236.01; 81/3.55, 3.56; 7/105, 151; D4/116, 118, 121; D8/34; D32/42

[56] References Cited

U.S. PATENT DOCUMENTS

| | | | |
|---|---|---|---|
| 181,206 | 8/1876 | Richardson | 15/111 |
| 471,562 | 3/1892 | Minnerly | 7/105 |
| 926,894 | 7/1909 | Pushee | 15/111 |
| 1,605,305 | 11/1926 | Vinje | 15/111 |
| 3,147,840 | 9/1964 | Brookhouser | 15/111 |
| 4,679,275 | 7/1987 | Shannon | 15/236.01 |
| 4,741,064 | 5/1988 | Riegert et al. | 15/111 |

FOREIGN PATENT DOCUMENTS

| | | | |
|---|---|---|---|
| 463364 | 2/1950 | Canada | 7/151 |
| 0551852 | 7/1993 | European Pat. Off. | 15/105 |
| 2602223 | 7/1977 | Germany | 15/111 |
| 141491 | 10/1930 | Switzerland | 15/105 |

*Primary Examiner*—Mark Spisich

[57] ABSTRACT

A brush for applying paint to a surface and effecting opening of a paint container. The inventive device includes a brush member having a handle with a plurality of brush fibers extending therefrom. A prying member is pivotally mounted to the handle and can be extended therefrom to effect prying of a lid of a paint container to open the container.

6 Claims, 4 Drawing Sheets

PRIOR ART

CONTAINER OPENING PAINT BRUSH

BACKGROUND OF THE INVENTION

1. Field of the Invention

The present invention relates to painting implements and more particularly pertains to a container opening paint brush for applying paint to a surface and effecting opening of a paint container.

2. Description of the Prior Art

The use of painting implements is known in the prior art. More specifically, painting implements heretofore devised and utilized are known to consist basically of familiar, expected and obvious structural configurations, notwithstanding the myriad of designs encompassed by the crowded prior art which have been developed for the fulfillment of countless objectives and requirements.

Known prior art painting implements include U.S. Pat. Nos. 5,259,281; 4,776,246; 3,946,453; U.S. Pat. No. Des. 292,244; and U.S. Pat. No. Des. 250,677.

While these devices fulfill their respective, particular objectives and requirements, the aforementioned patents do not disclose a container opening paint brush for applying paint to a surface and effecting opening of a paint container which includes a brush member having a handle with a plurality of brush fibers extending therefrom, and a prying member pivotally mounted to the handle which can be extended therefrom to effect prying of a lid of a paint container to open the container.

In these respects, the container opening paint brush according to the present invention substantially departs from the conventional concepts and designs of the prior art, and in so doing provides an apparatus primarily developed for the purpose of applying paint to a surface and effecting opening of a paint container.

SUMMARY OF THE INVENTION

In view of the foregoing disadvantages inherent in the known types of painting implements now present in the prior art, the present invention provides a new container opening paint brush construction wherein the same can be utilized for applying paint and prying open a paint container. As such, the general purpose of the present invention, which will be described subsequently in greater detail, is to provide a new container opening paint brush apparatus and method which has many of the advantages of the painting implements mentioned heretofore and many novel features that result in a container opening paint brush which is not anticipated, rendered obvious, suggested, or even implied by any of the prior art painting implements, either alone or in any combination thereof.

To attain this, the present invention generally comprises a brush for applying paint to a surface and effecting opening of a paint container. The inventive device includes a brush member having a handle with a plurality of brush fibers extending therefrom. A prying member is pivotally mounted to the handle and can be extended therefrom to effect prying of a lid of a paint container to open the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new container opening paint brush apparatus and method which has many of the advantages of the painting implements mentioned heretofore and many novel features that result in a container opening paint brush which is not anticipated, rendered obvious, suggested, or even implied by any of the prior art painting implements, either alone or in any combination thereof.

It is another object of the present invention to provide a new container opening paint brush which may be easily and efficiently manufactured and marketed.

It is a further object of the present invention to provide a new container opening paint brush which is of a durable and reliable construction.

An even further object of the present invention is to provide a new container opening paint brush which is susceptible of a low cost of manufacture with regard to both materials and labor, and which accordingly is then susceptible of low prices of sale to the consuming public, thereby making such container opening paint brushes economically available to the buying public.

Still yet another object of the present invention is to provide a new container opening paint brush which provides in the apparatuses and methods of the prior art some of the advantages thereof, while simultaneously overcoming some of the disadvantages normally associated therewith.

Still another object of the present invention is to provide a new container opening paint brush for applying paint to a surface and effecting of a paint container.

Yet another object of the present invention is to provide a new container opening paint brush which includes a brush member having a handle with a plurality of brush fibers extending therefrom, and a prying member pivotally mounted to the handle which can be extended therefrom to effect prying of a lid of a paint container to open the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set-forth above will become apparent when consideration is given to the following detailed description thereof. Such description makes reference to the annexed drawings wherein.

DESCRIPTION OF THE PREFERRED EMBODIMENT

Figure 1:
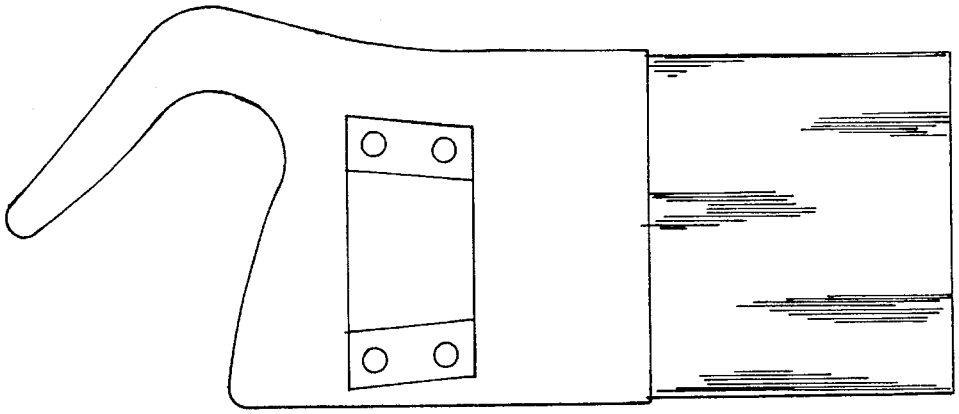
FIG. 1 is an elevation view of a prior art painting implement.

With reference now to the drawings, and in particular to FIGS. 3–8 thereof, a new container opening paint brush embodying the principles and concepts of the present invention and generally designated by the reference numeral 10 will be described.

Figure 2:
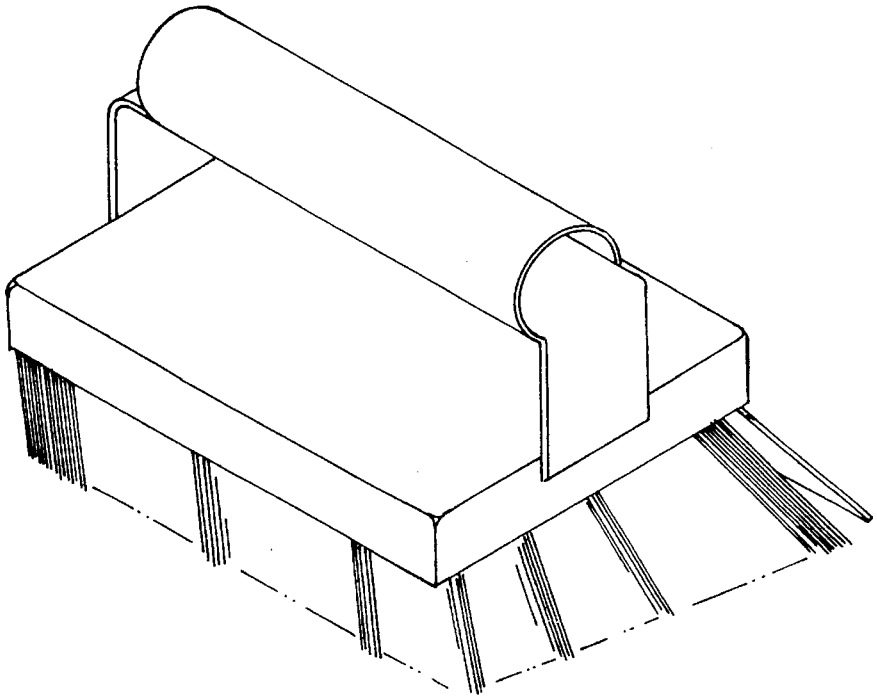
PRIOR ART Fig. 2
FIG. 2 is an isometric illustration of a further prior art painting implement

Turning initially to FIGS. 1 and 2 wherein prior art painting implements are illustrated, it can be shown that the prior art teaches paint brushes of various of designs including a handle having a plurality of fibers extending therefrom.

Figure 3:
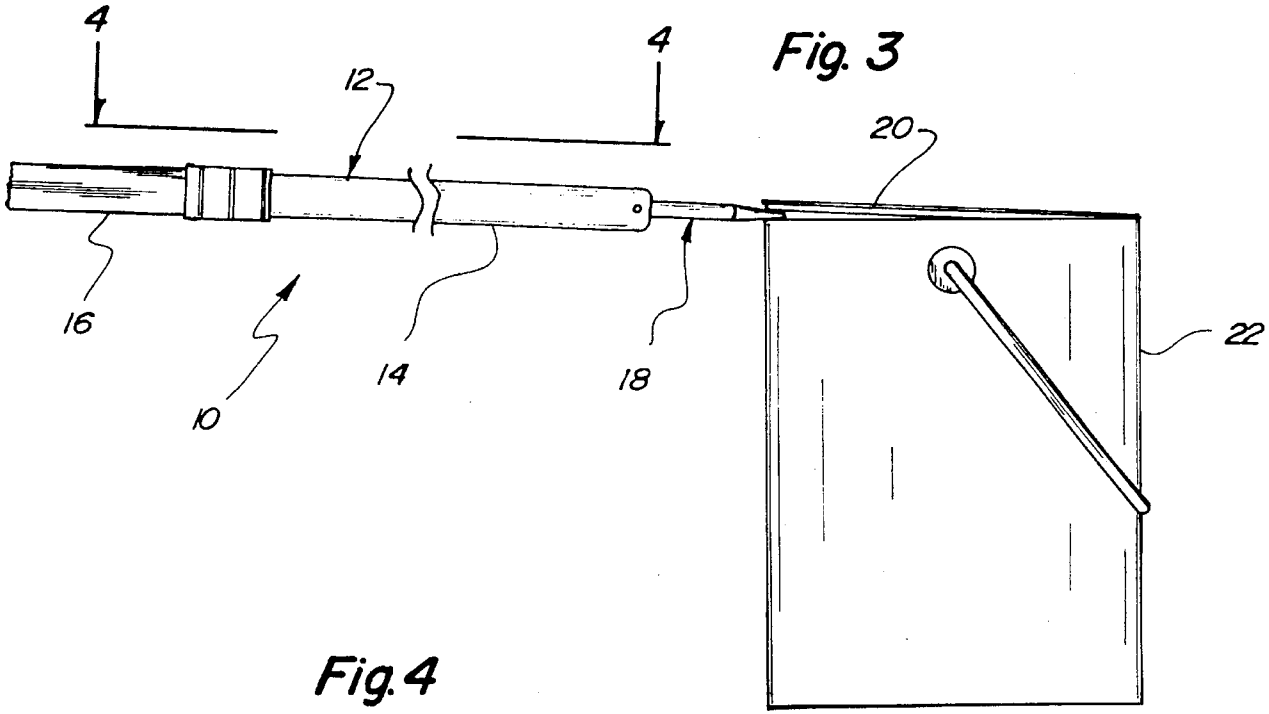
FIG. 3 is a side elevation view of a container opening paint brush according to the present invention in use.
Figure 4:
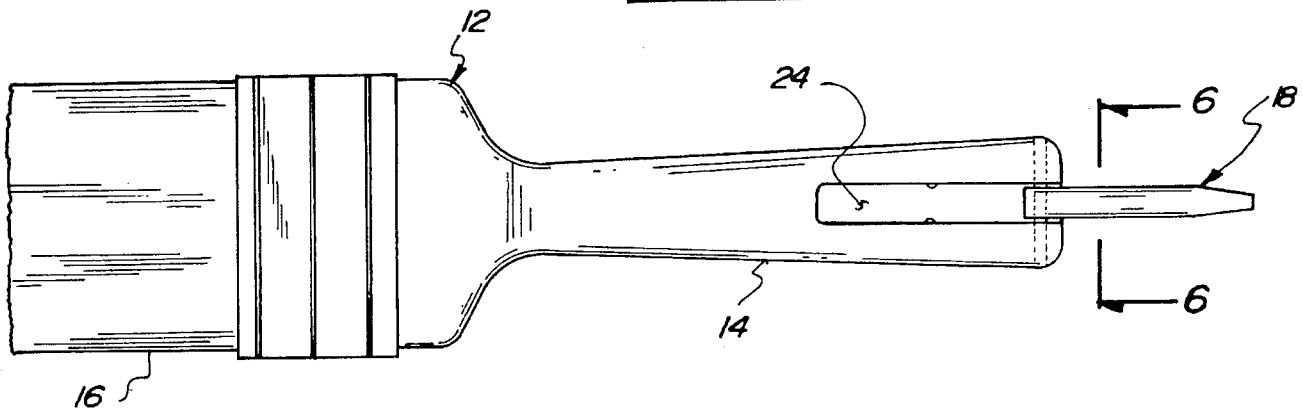
FIG. 4 is a top plan view of the invention, per se.

Turning now to FIGS. 3 through 8 wherein the present invention is illustrated in detail, it can be shown that the container opening paint brush 10 substantially departs from the designs and concepts of the prior art and comprises a brush member 12 including an elongated handle 14 having a narrow first end and flaring towards a second end thereof such that the second end is substantially wider than the first end. A plurality of brush fibers 16 extends from the second end of the handle 14 and operate to receive a fluid paint substance to effect application of such paint to a surface during painting thereof. A prying member 18 is pivotally mounted to the first end of the handle 14 and can be extended therefrom for effecting prying opening of a lid 20 of a paint can 22 as shown in FIG. 3 of the drawings.

Figure 5:
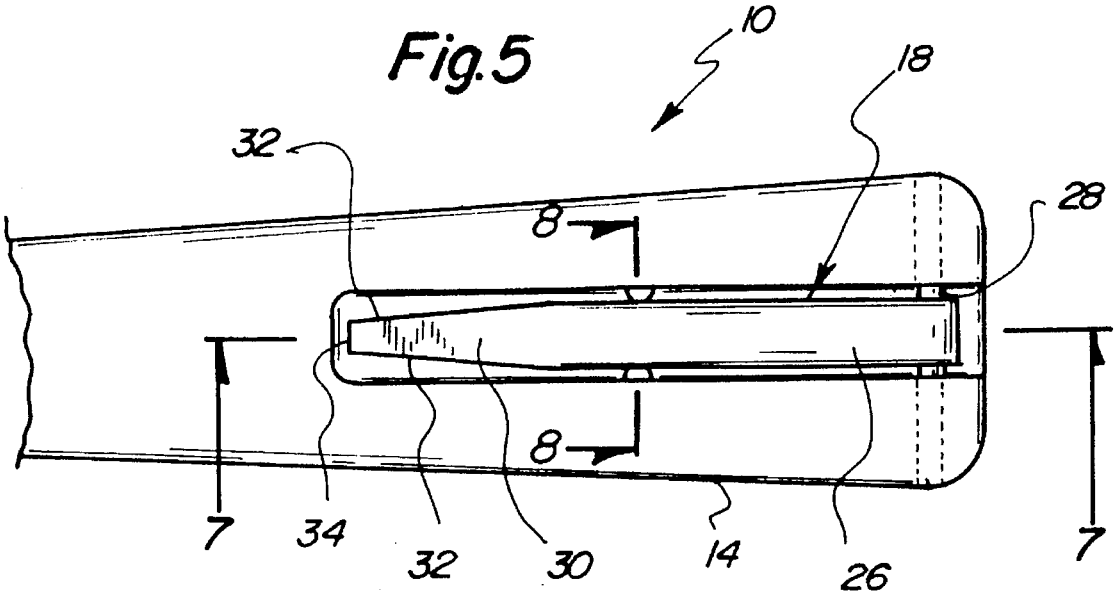
FIG. 5 is an enlarged top plan view of a portion of the present invention.
Figure 6:
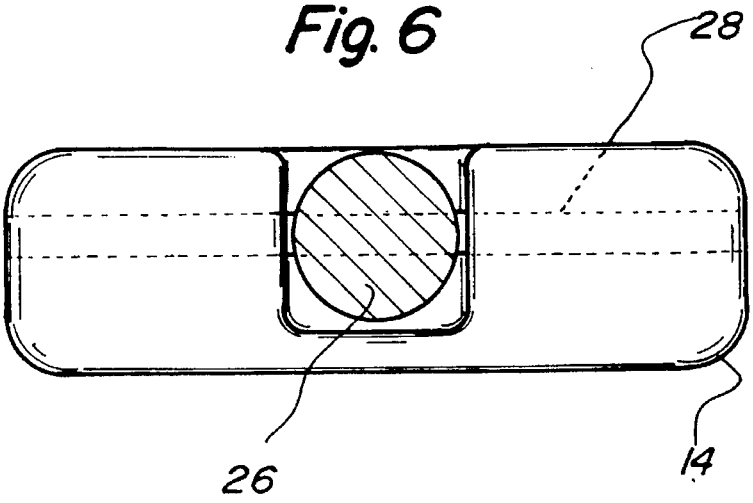
FIG. 6 is a cross sectional view taken along line 6—6 of FIG. 4.

As best illustrated in FIGS. 4 through 7, it can be shown that the handle 14 is shaped so as to define a channel 24 extending into a top surface thereof and oriented longitudinally along a portion of a longitudinal length of the handle 14. The channel 24 extends into contiguous communication with the first end of the handle 14 and permits the prying means 18 to be positioned within the handle 14 for storage as shown in FIG. 5 of the drawings. By this structure, the prying means 18 can be stored subsequent to use thereof in opening the lid 20 of the paint can 22 so as to preclude interference of the prying means 18 with an individual utilizing the device 10 to apply paint to a surface.

Figure 7:
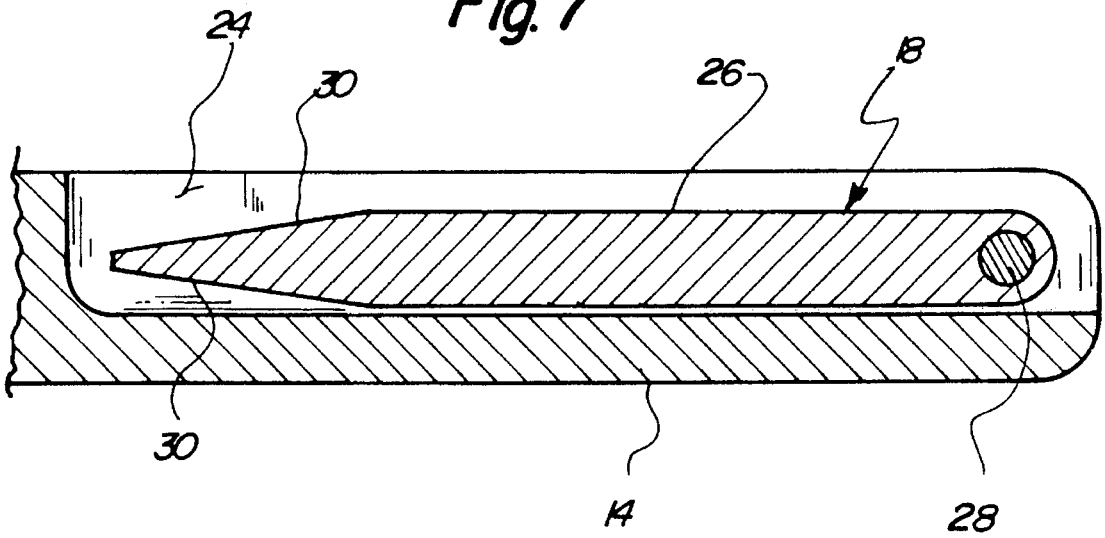
FIG. 7 is a cross sectional view taken along line 7—7 of FIG. 5.

Referring now to FIGS. 5 through 8, it can be shown that the prying means 18 of the present invention 10 preferably comprises a substantially elongated member 26 pivotally mounted within the channel 24 of the handle 14 proximal to a first end thereof by a pivot pin 28 extending through both a portion of the handle 14 and a portion of the elongated member 26. The pivot pin 28 thus permits the elongated member 26 to be pivoted from the orientation illustrated in FIG. 5 within the channel 24 into the orientation illustrated in FIG. 4 wherein the elongated member 26 extends from the first end of the handle 14. As shown in FIGS. 5 and 7, a second end of the elongated member 26 distal from the pivot pin 28 is shaped so as to define a pair of opposed planar engaging faces 30 which extend at an oblique angle relative to a longitudinal axis of the elongated member 26. The planar engaging faces 30 are flanked by lateral edges 32 which also extend at an oblique angle relative to a longitudinal axis of the elongated member 26. The planar engaging faces 30 cooperate with the lateral edges 32 to define a straight engaging tip 34 at the second end of the elongated member 26. The engaging tip 34 is operable to be positioned beneath a portion of the lid 20 of the paint container 22, whereby a moment force applied to the prying means 18 will effect separation of the lid 20 from the paint can 22.

Figure 8:
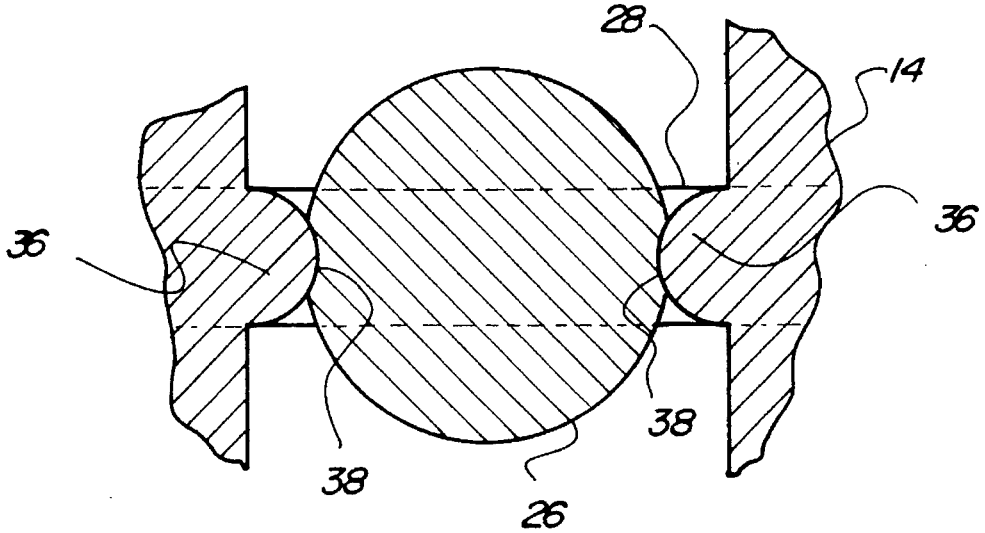
FIG. 8 is a cross sectional view taken along line 8—8 of FIG. 5.

As best illustrated in FIGS. 5 and 8, it can be shown that the prying means 18 desirably further includes a means for retaining the elongated member 26 within the channel 24 of the handle 14. To this end, the handle 14 is preferably shaped so as to define a pair of detent projections 36 extending from laterally opposed sides of the channel 24. The elongated member 26 is correspondingly shaped so as to define a pair of diametrically opposed detent notches 38 which are cooperatively aligned with the detent projections 36 such that when the elongated member 26 is pivoted into the channel 24, the detent projections 36 will engage the detent notches 38 so as to retain the elongated member 26 within the channel.

In use, the container opening paint brush 10 according to the present invention can be easily utilized for applying paint to a surface and/or effecting opening of a paint container 22 as shown in FIG. 3 of the drawings. The present invention 10 thus substantially eliminates a need for multiple tools to be carried by an associated painter.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A container opening paint brush comprising:

a brush member including an elongated handle, the handle having a narrow first end, spaced from and flaring towards a second end thereof such that the second end is substantially wider than the first end, and wherein the handle is shaped so as to define a channel extending into a top surface thereof and oriented longitudinally along a portion of a longitudinal length of the handle, the channel extending into contiguous communication with the first end of the handle;

a plurality of brush fibers extending from the second end of the handle; and a prying means comprising a substantially elongated member which is substantially cylindrical over a major portion of its length, said elongated member pivotally mounted within the channel of the handle proximal to a first end of the elongated member, said elongated member having an opposed second end distal from the pivotal mounting which is shaped so as to define a pair of opposed planar engaging faces which extend at an oblique angle relative to the longitudinal axis of the elongated member, said elongated member being pivoted into the channel of the handle for storage, and extendable from the first end of the handle for effecting prying open of a lid of a paint can.

2. A container opening paint brush comprising:

a brush member including an elongated handle, the handle having a narrow first end, spaced from and flaring towards a second end thereof such that the second end is substantially wider than the first end, and wherein the handle is shaped so as to define a channel extending into a top surface thereof and oriented longitudinally along a portion of a longitudinal length of the handle, the channel extending into contiguous communication with the first end of the handle, a plurality of brush fibers extending from the second end of the handle; and a prying means comprising a substantially elongated member, said elongated member pivotally mounted within the channel of the handle proximal to a first end of the elongated member, said elongated member having an opposed second end distal from the pivotal mounting which is shaped so as to define a pair of opposed planar engaging faces which extend at an oblique angle relative to a longitudinal axis of the elongated member, the planar engaging faces of the elongated member flanked by lateral edges of the elongated member which extend at an oblique angle relative to the longitudinal axis of the elongated member, said elongated member being pivoted into the channel of the handle for storage, and extendable from the first end of the handle for effecting prying open of a lid of a paint can.

3. The container opening paint brush of claim 2, wherein the planar engaging faces cooperate with the lateral edges to define a straight engaging tip at the second end of the elongated member.

4. The container opening paint brush of claim 3, wherein the elongated member is pivotally mounted within the channel of the handle by a pivot pin extending through both a portion of the handle and a portion of the elongated member.

5. The container opening paint brush of claim 4, wherein the prying means further includes a means for retaining the elongated member within the channel of the handle.

6. The container opening paint brush of claim 5, wherein the elongated member is shaped so as to define a pair of diametrically opposed detent notches extending thereinto; and further wherein the means for retaining the elongated member within the channel of the handle comprises a pair of detent projections extending from laterally opposed interior sides of the channel, the detent projections being aligned with the detent notches of the elongated member such that when the elongated member is pivoted into the channel, the detent projections will engage the detent notches to retain the elongated member within the channel.

* * * * *